US005407300A

United States Patent [19]

Guindon et al.

[11] Patent Number: 5,407,300

[45] Date of Patent: Apr. 18, 1995

[54] SYSTEM FOR VAPOR RECOVERY WITHOUT FORMATION OF FLUID BLOCKAGES AND A DUAL CONDUIT PIPE THEREFOR

[75] Inventors: Marc Guindon, Montreal, Canada; James L. Lawrence, Exton, Pa.; Homer Holden, Sylva, N.C.

[73] Assignee: Total Containment, Inc., Oaks, Pa.

[21] Appl. No.: 130,526

[22] Filed: Oct. 1, 1993

Related U.S. Application Data

[63] Continuation-in-part of Ser. No. 945,318, Sep. 10, 1992.

[51] Int. Cl.[6] ..... B65B 31/06

[52] U.S. Cl. ..... 405/53; 405/154; 137/588; 138/111; 141/59

[58] Field of Search ..... 137/236.1, 588; 138/105, 111, 115, 121, 173, 177, DIG. 11; 141/44, 45, 46, 59, 302; 405/36, 49, 51, 52, 53, 154

[56] References Cited

U.S. PATENT DOCUMENTS

| | | | |
|---|---|---|---|
| 987,398 | 3/1911 | Potter . | |
| 2,621,075 | 12/1952 | Sedar | 138/111 X |
| 2,814,529 | 11/1957 | Arnt | 138/111 X |
| 2,908,299 | 10/1959 | Gosselin . | |
| 3,187,936 | 6/1965 | Downing | 138/111 X |
| 3,905,405 | 9/1975 | Fowler et al. | 141/46 |
| 3,907,002 | 9/1975 | Gülich | 138/115 |
| 3,926,230 | 12/1975 | Stary et al. | 141/45 |
| 3,927,464 | 12/1975 | Wallsten . | |
| 4,086,937 | 5/1978 | Hechler, IV . | |
| 4,101,607 | 7/1978 | Bart . | |
| 4,145,157 | 3/1979 | Lascelles | 405/43 |
| 4,253,503 | 3/1981 | Gunn | 141/59 |
| 4,310,033 | 1/1982 | Deters | 141/44 |
| 4,995,759 | 2/1991 | Plowman et al. | 405/43 |
| 5,145,545 | 9/1992 | Winter et al. | 156/244.13 |
| 5,213,142 | 5/1993 | Koch et al. | 141/59 |

*Primary Examiner*—Randolph A. Reese
*Assistant Examiner*—John A. Ricci
*Attorney, Agent, or Firm*—Merek & Voorhees

[57] ABSTRACT

System for vapor recovery without formation of fluid blockages includes a vapor source, a fluid collection tank for collecting vapor, and a vapor recovery pipe extending between and fluidly collecting the vapor source and the fluid collection tank. The vapor recovery pipe slopes vertically downwardly from the vapor source to the fluid collection tank so that vapor flows into the fluid collection tank. The vapor recovery pipe has a main tube and an auxiliary tube disposed adjacent to the main tube. The vapor recovery pipe is engineered and is installed in such a manner that the vapor recovery pipe resists bending in a substantially vertical plane and allows bending in a substantially horizontal plane. Accordingly, the vapor recovery pipe according to the invention can be installed without surveying equipment, overcomes surface irregularities, and by resisting bending in a vertical direction ensures that no fluid blockages are formed along the length thereof. The bending of the vapor recovery pipe in the horizontal direction allows for the pipe to be installed around curves without the need for curved joints or couplings. To ensure continued functioning of the vapor recovery pipe even if one of the main and auxiliary tubes is blocked, one or more fluid transfer conduits can be provided that extend between and fluidly connect the main tube and the auxiliary tube.

16 Claims, 4 Drawing Sheets

SYSTEM FOR VAPOR RECOVERY WITHOUT FORMATION OF FLUID BLOCKAGES AND A DUAL CONDUIT PIPE THEREFOR

CROSS REFERENCE TO RELATED APPLICATIONS

This application is a continuation-in-part of U.S. patent application Ser. No. 07/945,318, filed Sep. 10, 1992, which is incorporated herein by reference.

FIELD OF THE INVENTION

This invention relates to a system for recovering vapor without the formation of fluid blockages, a dual conduit pipe for use in the vapor recovery system, and a method of installing such a system.

BACKGROUND OF THE INVENTION

It has long been recognized that unburned hydrocarbons, such as those released into the atmosphere during the conventional storage and distribution of gasoline, are harmful to the environment.

Attempts have been made to contain, collect, and recover vapors escaping from fluid distribution systems.

Given that gasoline, for example, is often stored in tanks underground and is distributed from underground pipes, known vapor recovery systems have experienced the drawbacks of recovered vapors liquefying and causing blockages in such known vapor recovery systems.

Liquefaction of recovered vapor typically occurs because the ambient temperature of the part of the vapor recovery system placed underground is often lower than the ambient temperature of the above ground parts of the vapor recovery system, especially in the summertime. Such liquid blockages not only prevent known vapor recovery systems from operating correctly, but can lead to underground fluid leaks which harm the environment.

Conventional systems are also difficult and expensive to install owing to the precise layout of the vapor recovery system required. Changes in elevation of vapor recovery systems can lead to undesirable formation of liquid blockages in the system.

Increasingly, local and federal regulations are requiring vapor recovery systems which are able to recover a greater percentage of vapors to prevent their escaping into the environment.

Accordingly, there is a need for a vapor recovery system which overcomes these and other drawbacks.

FEATURES AND SUMMARY OF THE INVENTION

It is a feature of the invention to provide a vapor recovery system for overcoming the problems of existing systems.

It is another feature of the invention to provide a dual conduit pipe which can be rolled up compactly for shipping and storage, and yet which is rigid in use.

It is also a feature of the invention to provide a dual conduit pipe which is configured for use with standard pipe couplings so as to ensure proper installation, given that a user will easily locate standard pipe fittings, thereby reducing the temptation of the user to use a broken part or to use an inferior substitute as often occurs when non-standard pipe fittings are required in conventional piping systems.

It is yet another feature of the invention to provide standard pipe couplings and ease of use of a dual conduit pipe system so as to increase user compliance with regulations, whereby system leaks are reduced and the environment is better protected than in previous systems.

It is another feature of the invention to provide a dual conduit pipe suited for use with a secondary containment pipe.

It is yet another feature of the invention to provide a dual conduit pipe which can transport fluid in one of the two dual conduits even if the other one of the dual conduits is blocked.

It is another feature of the invention to provide a dual conduit pipe in which passage of one or both of a vapor and a liquid is possible between the two tubes defining the dual conduit.

It is yet another feature of the invention to provide a dual conduit pipe which is substantially rigid in one plane yet is substantially flexible in another plane.

It is a further feature of the invention to provide a dual conduit tube in which each of the passages defining the dual conduits are maintained in the same position relative to each other.

It is a yet another feature of the invention to provide a vapor recovery system which can be operated at relatively low pressures.

It is a further feature of the invention to provide a dual conduit pipe suited for use with a vapor recovery system.

It is a still further feature of the invention to provide a method of installing a vapor recovery system that can be performed without the use of surveying equipment.

lit is a yet still further feature of the invention to provide a vapor recovery system which prevents the formation of fluid traps.

It is a further feature of the invention to provide a vapor recovery system which eliminates the need for connecting joints.

It is still further feature of the invention to provide a vapor recovery system eliminating the need for precision installation of the system.

It is a yet still further feature of the invention to provide a vapor recovery system which is relatively inexpensive to install, so that independent gas station operators can afford to retrofit their gas stations.

It is yet another feature of the invention to provide a vapor recovery system and method of installation that is easy to carry out, thereby increasing the speed of installation and, accordingly, reducing the downtime of a gasoline station to reduce the amount of money lost by the gas station owner during installation.

It is yet another feature of the invention to provide a vapor recovery system which can be installed without the use of complicated tools or sealing compounds which break down in the presence of hydrocarbons.

In summary, therefore, this invention is directed to a vapor recovery system that is accurate, inexpensive, easy to install properly, environmentally friendly, and eliminates the need for expensive tools and procedures. The vapor recovery system includes a vapor source, a fluid collection tank for collecting and storing the vapor recovered, and a dual conduit vapor recovery pipe sloping vertically downwardly from the vapor source to the fluid collection tank for causing the recovered vapor to flow into the fluid collection tank. The method of constructing the vapor recovery system according to the invention without the use of surveying equipment includes digging a trench in the ground extending from the vapor source to the fluid collection tank for collecting and storing vapor, and placing a vapor recovery pipe into the trench. The method further includes positioning the vapor recovery pipe for causing the recovered vapor to flow from the vapor source to the fluid collection tank.

DETAILED DESCRIPTION OF THE INVENTION

Figure 1:
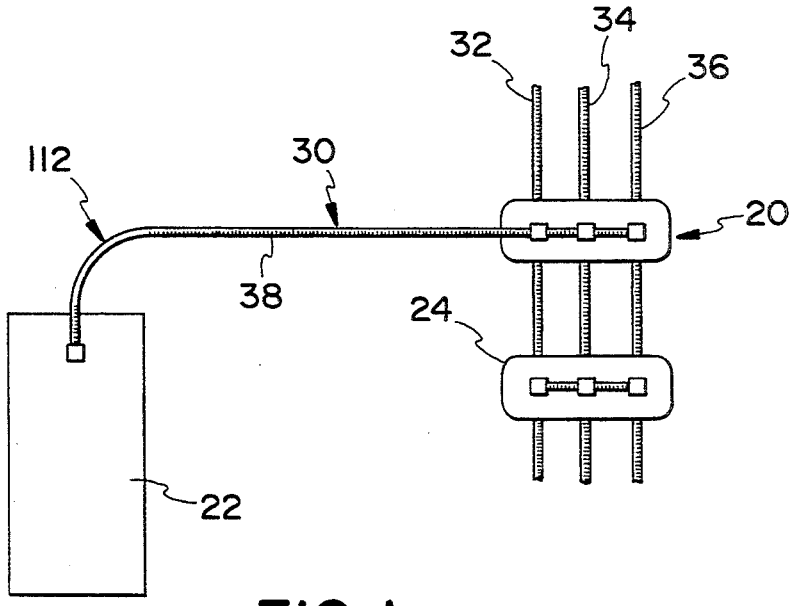
FIG. 1 is a schematic plan view of a vapor recovery system according to the invention.
Figure 2:
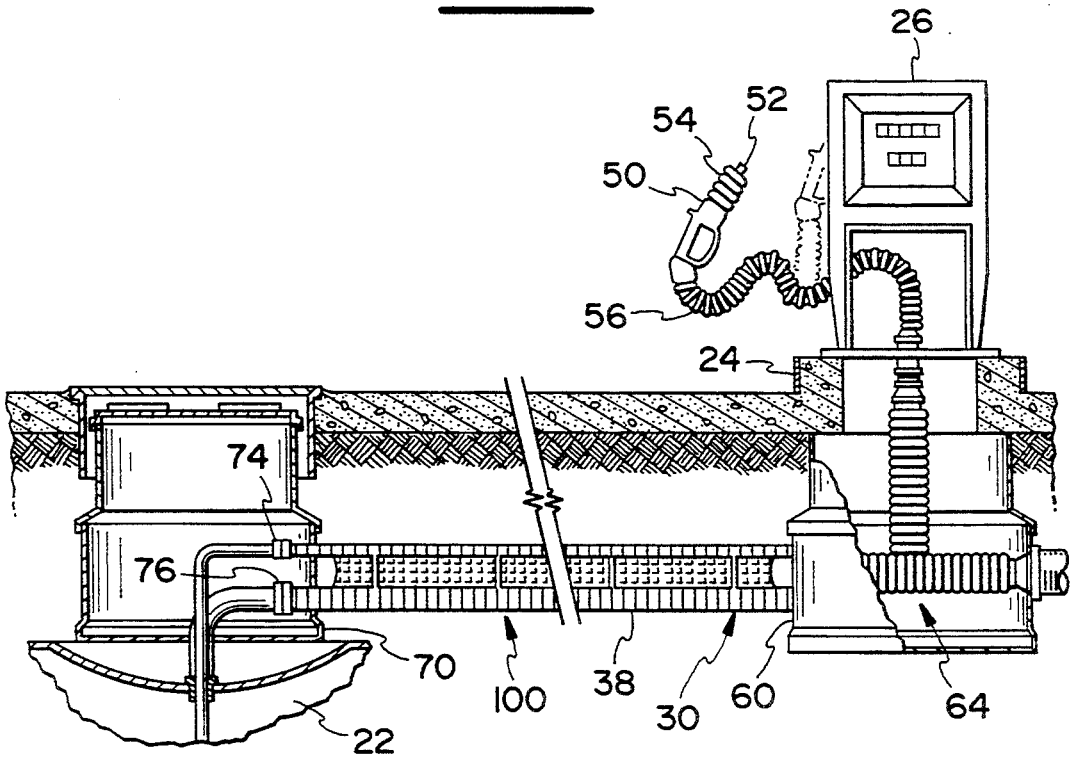
FIG. 2 is an elevational view, partially in section, of the vapor recovery system according to the invention.
Figure 3:
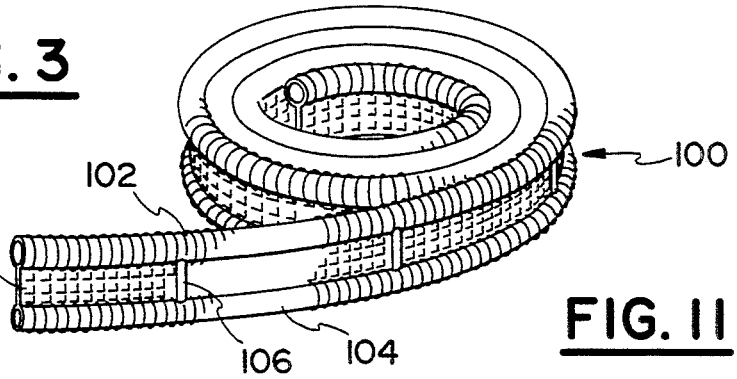
FIG. 3 is a perspective view of a dual conduit pipe used with the vapor recovery system according to a preferred embodiment of the invention.

Turning to FIGS. 1 and 2, a vapor recovery system 20 according to the invention is shown as typically installed underground. A fluid collection tank 22 is generally spaced from concrete islands 24 which support fluid dispensers 26 thereon.

A vapor recovery piping system 30 fluidly connects dispensers 24 with fluid collection tank 22.

Conveniently, in the case of a typical gasoline service station, which sells multiple grades of gasoline, a low octane piping 32, a medium grade piping 34, and a high octane piping 36 recover the vapor from the respective grades of gasoline and return the vapors to a common vapor return line 38, for example.

Vapor return line 38 is installed with or without secondary containment depending on the local regulations, the ambient environment, and the intended use. Of course, separate vapor recovery return lines could be provided for each grade of gasoline, as will be readily appreciated.

A conventional product dispenser handle 50 includes a nozzle 52 and a known vapor recovery nozzle hose 54.

Product dispenser handle 50 is shown "unholstered" (i.e., not in its normal resting position received by fluid dispenser 26 as shown in phantom line). Vapor recovery nozzle hose 54 is shown slightly retracted from the end of nozzle 52 for clarity.

In practice, vapor recovery nozzle hose 54 is retracted when the consumer inserts nozzle 52 into the gasoline fill tube of the consumer's vehicle (not shown) so that the vapor recovery nozzle hose 54 mates with the edges of the vehicle fill tube and recovers escaping gasoline vapors which may be forced out of the consumer's gasoline tank during the filling thereof, as will be readily appreciated. A conventional vapor recovery return hose 56 fluidly connects vapor recovery nozzle hose 54 to piping system 30.

A sump riser 60 installed beneath concrete island 24 and fluid dispenser 26 maintains the proper position and attitude of fluid coupling component 64 which connect vapor recovery return hose 56 to the remainder of piping system 30.

A collection sump riser 70 is typically installed above fluid collection tank 22. One or more of the pipelines for recovering the different grades of gasoline vapor, such as common vapor return line 38 or low octane piping 32, extends from collection sump riser 70 to sump riser 60.

Preferably, vapor return line 38 is a dual conduit fluid recovery pipe 100 having a first conduit or main tube 102, a second conduit or auxiliary tube 104, and one or more channels or fluid transfer conduits 106 fluidly connecting first conduit 102 and second conduit 104, as described in detail below. It should be understood that the terms "main" and "auxiliary" are used for convenience, as either one of main tube 102 and auxiliary tube 104 will carry the majority of fluids, depending on the fluids being transported, the type of installation, ambient conditions, and the like.

A series of standard fluid couplings 74 and 76 fluidly connect the respective conduits of pipe 100 with fluid collection tank 22.

Understandably, all joints and interfaces between vapor recovery pipe 100 with sump riser 60 and collection sump riser 70, for example, will be made fluid tight to prevent escape of the recovered vapor into the ground and/or the atmosphere, as required.

FIGS. 3–7 show additional details of dual conduit vapor recovery pipe 100 according to a first preferred embodiment of the invention.

Vapor recovery pipe 100 includes a web 110 extending between main tube 102 and auxiliary tube 104.

A height y of dual conduit vapor recovery pipe 100 is typically about 6.5" when the inside diameter of main tube 102 is about 2.0 inches and the inner diameter of auxiliary tube 104 is about 1.0 inches. The various dimensions of vapor recovery pipe 100 are likewise selected so that bending of vapor recovery pipe 100 is enhanced in a first direction out of the plane of the paper as viewed in FIG. 4. Furthermore, it is preferred that resistance to bending be imparted in a second direction. The second direction extends transversely to the first direction (i.e., the second direction extends substantially perpendicularly to the longitudinal axis of pipe 100 and is contained in the plane of the paper).

The thickness of pipe wall 118, web 110, auxiliary tube wall 120, the size, length, and thickness of fluid transfer conduit 106, and the material from which vapor recovery pipe 100 is made are also chosen to give pipe 100 the desired characteristics.

The appropriate characteristics of vapor recovery pipe 100 will become even more apparent after considering the description of the method of installing the vapor recovery system and its use described below.

A plurality of raised portions 130 are disposed on and extend outwardly from the remainder of web 110. A plurality of ribs 134 can be provided on the outside of main tube 102. Similarly, a plurality of ribs 138 may be provided on the exterior of auxiliary tube 104. Raised portions 130 can be configured to enhance the desired bending in the first direction out the plane of the paper as viewed in FIG. 4 such as by configuring raised portions 130 as substantially elongated rectangles. Raised portions 130 likewise have a practical value during the manufacturing process in that raised portions 130 function as areas (strictly speaking, volumes) into which excess material is squeezed or relieved during the pressing together of the two halves 140 and 142 of vapor recovery pipe 100.

It has also been found that ribs 134 and 138 are useful during the manufacturing process, especially when pipe 100 is formed during a substantially continuous process where successive lengths of a continuous pipe are formed sequentially. In the case of a long pipe molded in sequential increments, ribs 134 and 138 function as useful protrusions which can be grabbed and pulled upon in the direction of elongation of pipe 100 (i.e., along the longitudinal axis of pipe 100) during the molding process. However, it is preferred that no ribs be provided.

Figure 8:
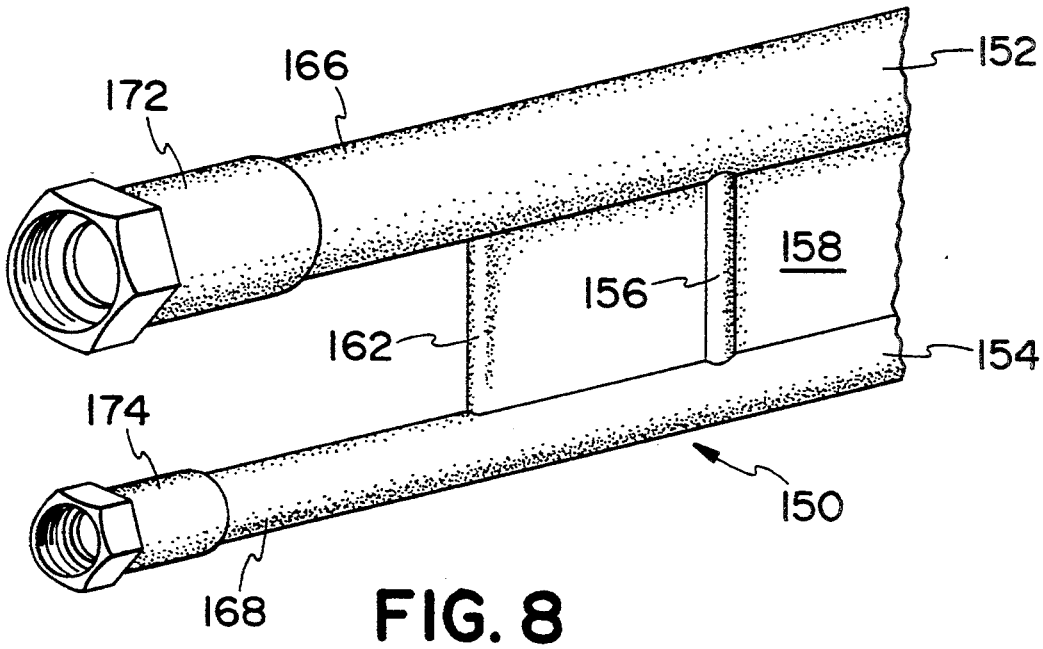
FIG. 8 is a perspective view of another preferred embodiment of the dual conduit pipe according to the invention.

FIG. 8 illustrates another preferred embodiment of a dual conduit vapor recovery pipe 150 according to the invention.

The dual conduit vapor recovery pipe 150 of FIG. 8 includes a main conduit 152 having substantially smooth interior and exterior walls and an auxiliary conduit or tube 154 likewise having substantially smooth interior and exterior walls. A plurality of fluid transfer conduits 156 fluidly connect main tube 152 and auxiliary tube 154, as in the previous embodiment. A substantially flat web 158 connects and imparts the desired bending and resistance-to-bending characteristics to vapor recovery pipe 150 as in the previous embodiment shown in FIGS. 2–7.

A leading edge 162 of web 158 remains after a portion of web 158 has been removed to provide a free end 166 of main conduit 152 and a counterpart free end 168 of auxiliary conduit 154. A pair of standard pipe fittings 172 and 174 are shown connected to free ends 166 and 168, respectively.

Figure 9:
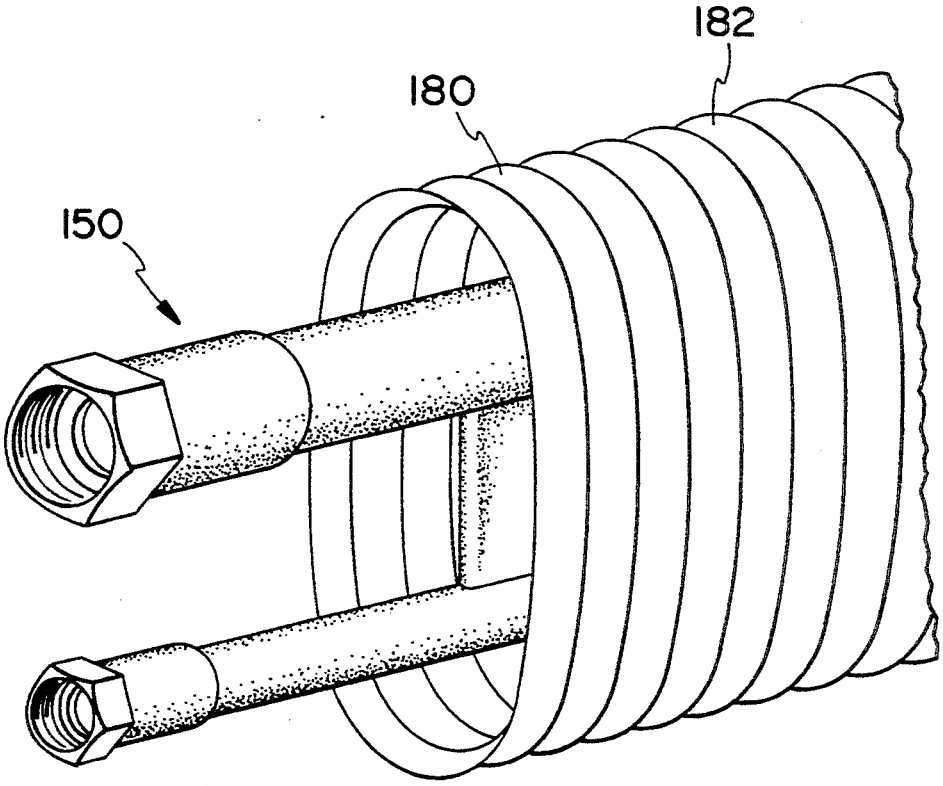
FIG. 9 is a perspective view of a dual conduit pipe according to the invention as used in a secondary containment system according to the invention.

FIG. 9 illustrates the placement of dual conduit vapor recovery pipe 150 in a secondary containment pipe 180.

Secondary containment pipe 180 includes a plurality of corrugations 182 and is formed as a substantially elliptical pipe. Preferably, secondary containment pipe 180 is configured both for strength, as secondary containment pipe 180 will typically be buried underground, and for enhanced bending and resistance to bending which is substantially similar to and compliments the bending and resistance-to-bending characteristic of vapor recovery pipe 150.

Figure 10:
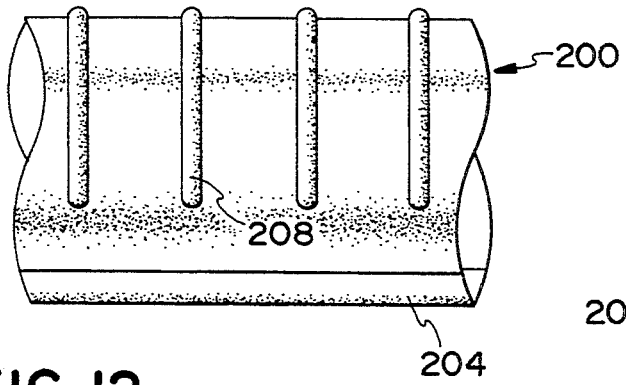
FIG. 10 is a side elevational view of yet another embodiment of a vapor recovery pipe according to the invention.
Figure 11:
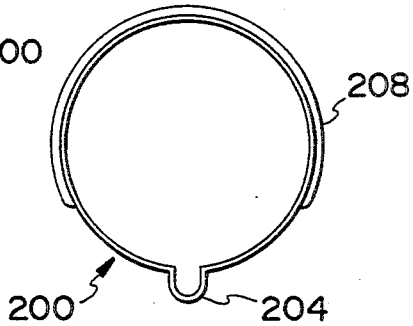
FIG. 11 is an end view of the vapor recovery pipe of FIG. 10.

FIGS. 10 and 11 show a yet still further preferred embodiment of a vapor recovery pipe 200 according to the invention, in which a fluid or liquid transport channel 204 extends along the length of conduit 200 and eliminates the need for both a separate auxiliary tube and a fluid transfer conduit. The bulk of the volume of pipe 200 serves as a main tube. The main tube and channel 204 are configured for rigidifying pipe 200 in its direction of elongation. A plurality of ribs 208 may be provided, for example.

Figure 12:
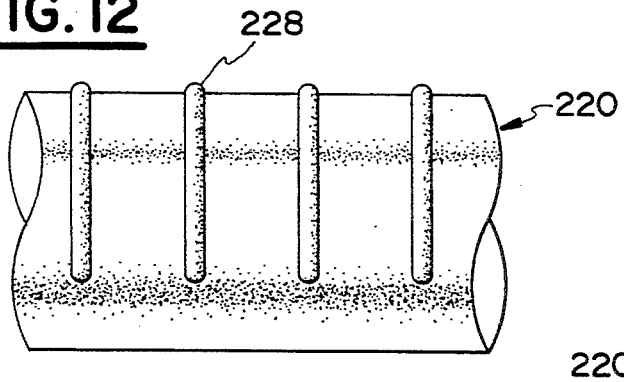
FIG. 12 is a side elevational view of a still further preferred embodiment of a vapor recovery pipe according to the invention.
Figure 13:
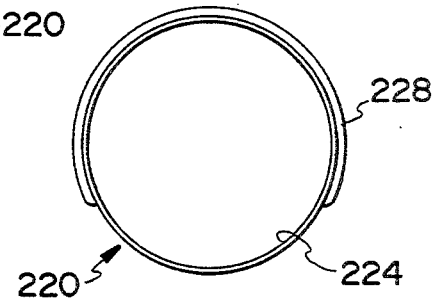
FIG. 13 is an end view of the vapor recovery pipe of FIG. 12.

FIGS. 12 and 13 illustrate yet another preferred embodiment of a vapor recovery pipe according to the invention in which a substantially smooth interior bottom 224 is provided. Strengthening ribs 228 may be added as in the embodiments described above.

Figure 14:
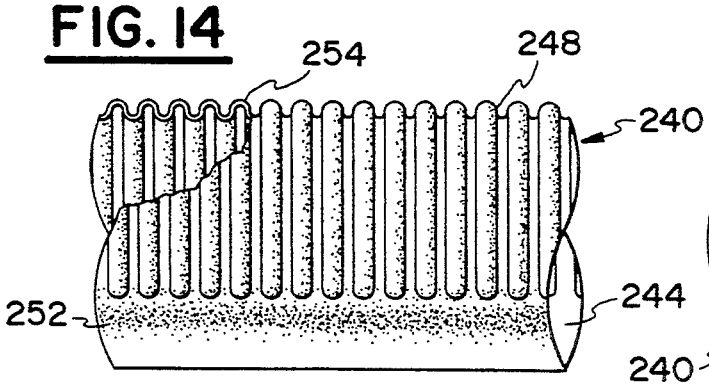
FIG. 14 is a side elevational view, partly in section, of another preferred embodiment of a vapor recovery pipe according to the invention.
Figure 15:
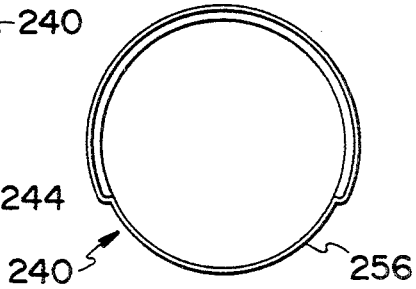
FIG. 15 is an end view of the vapor recovery pipe of FIG. 14.
Figure 4:
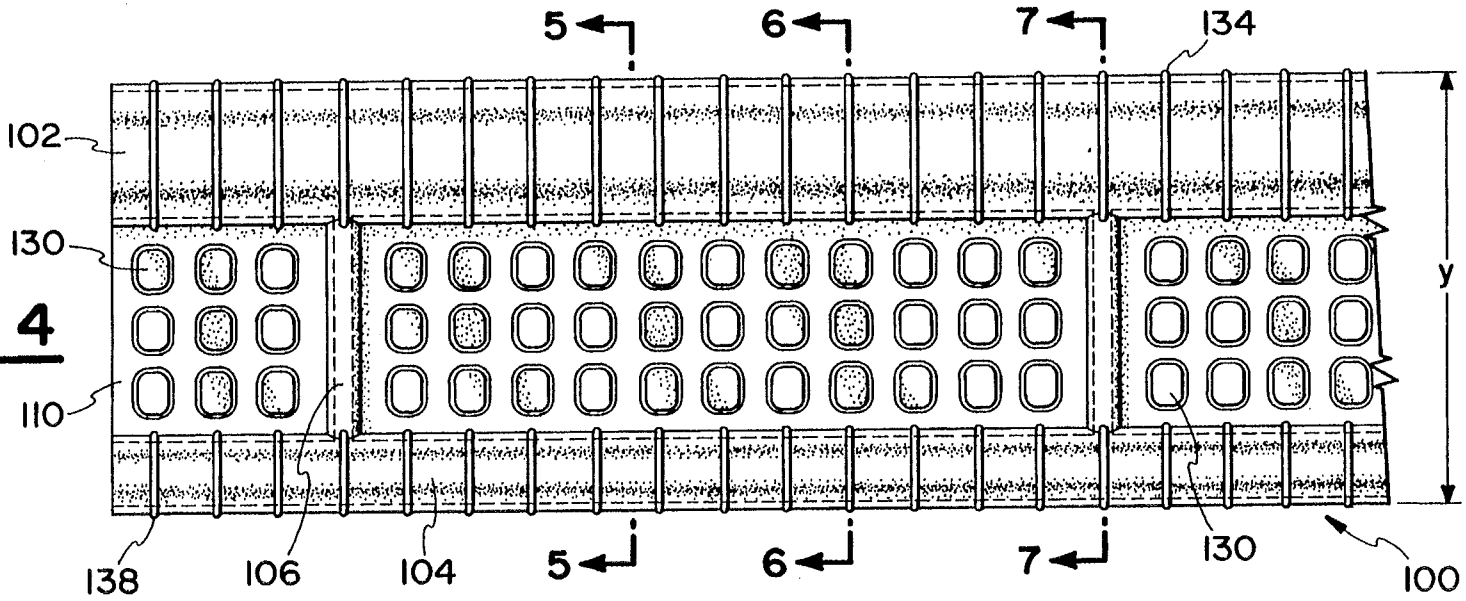
FIG. 4 is a side elevational view of the pipe of FIG. 3.
Figure 7:
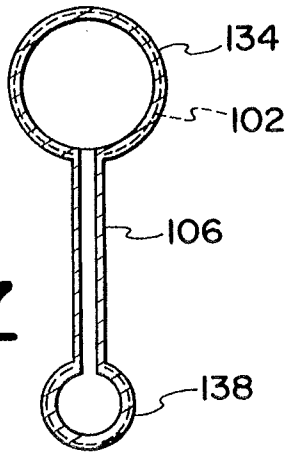
FIG. 7 is a sectional view of the dual conduit pipe according to the invention, taken along line 7—7 of FIG. 4.
Figure 6:
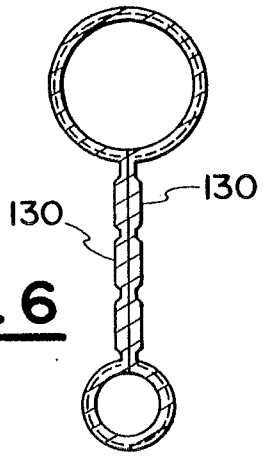
FIG. 6 is a sectional view of the dual conduit pipe according to the invention, taken along line 6—6 of FIG. 4.
Figure 5:
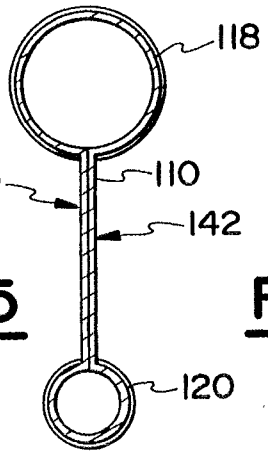
FIG. 5 is a sectional view of the dual conduit pipe according to the invention, taken along line 5—5 of FIG. 4.

Yet another preferred embodiment of a vapor recovery pipe 240 is shown in FIGS. 14 and 15. Vapor recovery pipe 240 includes a substantially smooth lower interior portion 244 particularly suited for the flow of liquids as well as gases, along with a plurality of corrugations 248 disposed in upper portions thereof. Corrugations 248 along with a lower wall portion 252 provide the desired strengthening and bending characteristics. The thickness of a wall 254 of corrugations 248 is selected, along with the selection of a thickness of a wall 256 of lower wall portion 252, so that bending of single conduit 240 is enhanced in a first direction substantially perpendicular to the direction of elongation of single conduit 240, while resistance to bending is enhanced in a second direction, the second direction being substantially perpendicular to both the first direction and the direction of elongation.

OPERATION

To install vapor recovery system 20 according to the invention, in the case of installation underground the user digs an elongated trench in the ground between collection sump riser 70 and sump riser 60. The user then places vapor recovery pipe 100 into the trench, after substantially smoothing out an optional supporting bed of gravel at a desired slope, for example.

It is important that vapor recovery pipe 100 be positioned in the trench so that the desired bending and resistance to bending characteristics inherent in the configuration of pipe 100 are fully utilized. Thus, it is preferred that main tube 102 be positioned substantially vertically below auxiliary conduit 104.

The vertical height of one or both ends of vapor recovery pipe 100 is adjusted, as necessary, for causing vapor recovery pipe 100 to slope vertically downwardly from sump riser 60 (i.e., the vapor source) to fluid collection tank 22 (i.e., to collection sump riser 70).

Finally, the installer fluidly connects the free ends 166 and 168 of vapor recovery pipe 100 to the respective fluid couplings 76 and 74.

If separate piping is used for each grade of gasoline, for example, the above steps are repeated as necessary, a single trench generally being adequate for carrying more than one type of recovery piping. Preferably, a single, unbroken length of vapor recovery pipe 100 extends from collection sump riser 70 to sump riser 60, so as to reduce the number of intermediate unions or couplings and, hence, the chance of recovered vapor being lost.

Given the resistance to bending of vapor recovery pipe 100 in the vertical direction, when installed as described above, irregularities in the surface of the base of the trench in which vapor recovery pipe 100 is laid do not lead to vapor blockages. That is, the rigidity of vapor recovery pipe 100 in the vertical plane causes pipe 100 to span irregularities, rather than to conform to such irregularities. In this manner, the drawbacks of conventional vapor recovery pipes in which depressions along the length of the pipe lead to liquid build-up of condensed vapor, which liquid build-up prevents the passage of vapor, are eliminated.

By the use of the elongated pipe according to the invention, a relatively straight uninterrupted fluid path is provided for recovered vapor, despite irregularities in the surface on which vapor recovery pipe 100 is laid.

Additionally, given the enhanced flexibility of vapor recovery pipe 100 in a second direction (i.e., enhanced flexibility and ability to bend within a substantially horizontal plane when installed as described above) vapor recovery pipe 100 is able to conform to bends in the trench without collapsing and without the need for couplings. By precluding collapsing of the walls that restricts fluid flow and by eliminating the use of most couplings, the loss of recovered vapor is enhanced even more.

In addition, given transfer conduits 106, even if a blockage in one of main tube 102 or auxiliary tube 104 occurs, fluid will bypass such blockage via one or more transfer conduits 106.

Furthermore, it is contemplated that the preferred embodiments of the dual conduit vapor recovery pipes according to the invention that have a web extending between the main and auxiliary tubes will be easily installed without the need to lay the vapor recovery pipe on the bottom of a trench nor on a bed of gravel. For example, after the trench has been dug, the user can simply drive stakes into the bottom of the trench at spaced apart intervals and then fasten the vapor recovery pipe to the stakes such as by gluing, stapling, or nailing the web thereto. Furthermore, it is contemplated that even the use of stakes be eliminated, and that the user will nail or otherwise directly attach the web to a vertical wall of the trench.

It is likewise contemplated that both the main tube and the auxiliary tube have substantially equal inside diameters. It is also contemplated that the ratio of the inside diameter of the larger tube to the inside diameter of the smaller tube be less than or greater than the 2:1 ratio of the preferred embodiment of FIGS. 3–7.

It is further expected that when a secondary containment pipe surrounds the dual conduit vapor recovery pipe, for convenience both the main and auxiliary tubes will have substantially the same inside diameter.

It is likewise anticipated that different cross sectional shapes for the tubes be used; i.e., it is expected that tubes having cross sectional shapes such as triangles, squares, polygons, ellipses, and other configurations will be used.

In use, it is expected that the vapor recovery system will be operated under low to zero pressure (e.g., a typical working pressure of 50 psi (pounds per square inch) is contemplated.

A vapor recovery pipe according to the invention can be made by conventional plastic forming techniques. The vapor recovery pipe is preferably made of a material which is not substantially affected by contact with hydrocarbons, such as gasoline. Such plastic materials may include polyethylene, such as high density polyethylene (HDPE) and urethane, for example. For underground installation, it is preferable that the vapor recovery pipe be made of material resistent to attack by soil microbes, and be non-biodegradable.

It is also contemplated that other suitable materials which are impermeable to fuel constituents be used, for example, modified polypropylene, fluoropolymers, and the like.

It is likewise expected that vapor recovery will be performed from a variety of vapor sources including sump risers, dispenser sumps, dispenser pans, and other typical vapor sources.

It is also expected that for enhanced containment of fluids transported through the pipes, that coextruded conduits be made. Coextruded materials effectively produce multilayer walls which provide secondary containment.

The nature of the barrier performance required will determine whether the barrier is internal, external, or contained within one of the layers. For example, it is contemplated that in the case of a five layer conduit, the layers will include: polyethylene, nylon, polyvinyl alcohol, fluoropolymers, or other suitable polymers or elastomers. For example, a conduit may be made having a polyethylene layer, an adhesive layer, a barrier layer, an adhesive layer, and a polyethylene layer. Such coextrusions are known in the bottling industry, as in plastic containers for volatile liquids, containers for transporting materials such as organic solvents, cleaners, mixtures of different volatiles, fuel-burning enhancers such as ether, and even perfumes. This coextrusion of a vapor recovery pipe according to the invention is made by a process such as described in U.S. Pat. No. 5,145,545 to Winter et al., which is incorporated herein by reference. The Winter et al. patent shows how two or more polymers are used to make a single conduit pipe having multiple layers.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. A fluid transport pipe, comprising:

a) a substantially fluid-tight main tube;

b) a substantially fluid-tight auxiliary tube disposed adjacent to said main tube;

c) a plurality of fluid transfer conduits disposed between and fluidly connecting said main tube and said auxiliary tube; and d) a web disposed between and physically connecting said main tube and said auxiliary tube.

2. A fluid transport pipe as defined in claim 1, wherein:

a) said web is disposed between and physically connects adjacent ones of said plurality of fluid transfer conduits.

3. A fluid transport pipe as defined in claim 1, wherein:

a) said main tube has a predetermined internal diameter;

b) said auxiliary tube has a predetermined internal diameter; and c) said internal diameter of said main tube is greater than said internal diameter of said auxiliary tube.

4. A fluid transport pipe as defined in claim 1, wherein:

a) said web is configured for substantially rigidifying said fluid transport pipe in a direction transverse to the longitudinal axis of said plurality of fluid transfer conduits.

5. A fluid transport pipe as defined in claim 1, wherein:

a) said main tube, and said auxiliary tube, and said fluid transfer conduits are made of materials which are impermeable to fuel constituents.

6. A fluid transport pipe as defined in claim 1, wherein:

a) a liquid transport channel is disposed along and fluidly connected to a length of one of said main and auxiliary tubes.

7. A fluid transport pipe as defined in claim 1, further comprising:

a) a secondary containment pipe substantially surrounding each one of said main tube, said auxiliary tube, and said plurality of fluid transfer conduits.

8. A system for vapor recovery without the formation of fluid blockages, comprising:

a) a vapor source;

b) a fluid collection tank for collecting vapor;

c) a vapor recovery pipe disposed between and fluidly connecting said vapor source to said fluid collection tank;

d) said vapor recovery pipe sloping vertically downwardly from said vapor source to said fluid collection tank for causing a vapor recovered from said vapor source to flow into said fluid collection tank;

e) said vapor recovery pipe having:

i) a main tube; and ii) an auxiliary tube disposed adjacent to said main tube.

9. A system as defined in claim 8, wherein:

a) a plurality of fluid transfer conduits is disposed between and fluidly connects said main tube and said auxiliary tube; and b) a web is disposed between and physically connects said main tube and said auxiliary tube.

10. A system as defined in claim 8, wherein:

a) said vapor source includes a dispenser pan.

11. A system as defined in claim 8, wherein:

a) said fluid collection tank includes means for storing vapor and liquids.

12. A system as defined in claim 8, wherein:

a) a vertically downwardly sloping trench is provided;

b) said vapor recovery pipe is disposed in said trench; and c) wherein, said vapor recovery pipe conforms to variations in the sloping trench in a substantially horizontal plane and resists bending in a substantially vertical plane, whereby a substantially evenly downwardly sloping fluid path within said vapor recovery pipe is obtained.

13. A system as defined in claim 8, wherein:

a) said vapor source includes a plurality of dispenser sumps; and b) said vapor recovery pipe includes a plurality of pipes for fluidly connecting said plurality of dispenser sumps to said fluid collection tank.

14. A system as defined in claim 13, wherein:

a) said fluid collection tank includes means for storing a plurality of different recovered vapors; and b) whereby, when each one of said plurality of pipes is connected to said plurality of dispenser sumps, a variety of different vapors can be recovered and separately stored.

15. A method of constructing a vapor recovery system without the use of surveying equipment, said vapor recovery system recovering vapor without the formation of fluid blockages, comprising:

a) digging an elongated trench in the ground without the use of surveying equipment, the trench extending from a vapor source to a fluid collection tank for collecting and storing vapor;

b) placing a vapor recovery pipe having a main tube and an auxiliary tube disposed adjacent to said main tube in the trench;

c) positioning the vapor recovery pipe in the trench for causing the main tube to be disposed substantially vertically below the auxiliary tube;

d) adjusting the vertical height of at least one end of the vapor recovery pipe for causing the vapor recovery pipe to slope vertically downwardly from the vapor source to the fluid collection tank for causing a vapor recovered from the vapor source to flow downwardly into the fluid collection tank; and e) fluidly connecting the vapor recovery pipe to the fluid collection tank and to the vapor source.

16. A method as defined in claim 15, further comprising the steps of:

a) placing a plurality of vapor recovery pipes in the trench; and b) fluidly connecting each one of the plurality of fluid recovery pipes to the vapor source and the fluid collection tank for recovering a variety of different vapors.

* * * * *